United States Patent [19]

Pagel

[11] 4,372,082

[45] Feb. 8, 1983

[54] STORM WINDOW UNIT HAVING EXPANDABLE FRAME

[76] Inventor: Gary A. Pagel, 10107 NE. 37th St., Vancouver, Wash. 98662

[21] Appl. No.: 235,593

[22] Filed: Feb. 18, 1981

[51] Int. Cl.[3] ..... E05B 65/04

[52] U.S. Cl. ..... 49/62; 49/505

[58] Field of Search ..... 49/61, 62, 63, 505; 160/377

[56] References Cited

U.S. PATENT DOCUMENTS

| | | | |
|---|---|---|---|
| 2,727,596 | 12/1955 | Smith | 49/505 X |
| 2,923,351 | 2/1960 | Zitomer | 49/61 X |
| 4,279,288 | 7/1981 | Lanier | 160/377 |

*Primary Examiner*—Kenneth Downey

*Attorney, Agent, or Firm*—Chernoff & Vilhauer

[57] ABSTRACT

A storm window unit incorporating extruded metal frame members assembled in the form of an inner frame including slide tracks for holding removable, slidably movable window panels, and an outer frame comprising a plurality of expander caps fitted about the inner frame and movable by jackscrews to expand the outer dimensions of the window unit. The expander caps extend preferably along three sides of the inner frame, and corner caps are provided to fill any gaps created between the ends of adjacent frame members by expansion of the outer frame, so that the window unit can be installed to fit snugly and sealingly within window openings which are slightly oversize or which are of distorted or otherwise irregular shape.

4 Claims, 7 Drawing Figures

STORM WINDOW UNIT HAVING EXPANDABLE FRAME

BACKGROUND OF THE INVENTION

The present invention relates to storm window units, and particularly to a metal frame storm window unit incorporating an expandable frame.

Recent rises in the cost of heating buildings have made it economical to increase the amounts of insulation used in construction of buildings. Windows in newer buildings are now furnished with thermally insulating double glazing which includes a thin air space between a pair of parallel panes. In older buildings, and particularly in older homes, however, windows were until recently provided with a single pane of glass, and separately mounted storm windows were used to provide additional control of heat loss.

In many areas of the country, buildings were previously not equipped with exterior windows, yet the cost of heating has recently made it highly desirable to provide the insulating qualities of a dead air space trapped between parallel sheets of glass in a window. This can be economically accomplished by mounting storm windows having modern frames of, for example, extruded aluminum, within the original casing of an existing window. In fact, storm windows can provide better insulation than double glazed windows, if they are properly and tightly installed, since they provide a thicker dead air space between the panes of glass.

There are, however, several problems related with installation of metal frame windows within the casings of preexisting single glazed windows. For example, in older buildings which have begun to sag with age, window casings have sometimes become slightly misshapen as a result of sagging of the building's walls. Standard sized storm windows, then, can not be used in such window openings without field modification of the storm window or repair of the window opening. If it is desired to custom build storm window units to fit in such window openings, precise measurements must be made and followed accurately in construction of each window unit. Since the window units are assembled in a shop before installation, there are several opportunities for errors in measurement, often resulting in storm window units which do not fit the opening properly. It then becomes necessary either to modify the storm window unit, sometimes resulting in an installation which is not particularly attractive in appearance, or to build a new window unit to the correct measurements. Neither of these courses of action is particularly economical of time or materials.

Particularly in the case of storm windows mounted on the interior side of a pre-existing house window, it is often desirable to remove the storm window and its frame completely, to improve appearance during warm weather or to facilitate repair of the primary window. With previously known interior mounted storm windows, particularly those which have been specially made to fit out-of-square window casings, this is frequently difficult.

What is needed, therefore, is a storm window unit which may be installed on the interior side of a pre-existing window, within the pre-existing window casing, despite some misalignment of the window casing, and despite errors in measurement of the window casing prior to construction of the storm window unit. It is also desirable to have such a storm window unit be efficient in performance and attractive in appearance, as well as economical to install.

SUMMARY OF THE INVENTION

The present invention overcomes the problems of installation presented by previous storm windows which made them expensive and sometimes difficult and tedious to install, by providing a storm window unit having an expandable outer frame disposed around an inner frame of fixed dimensions and regular shape. A plurality of jackscrews located at spaced intervals along the periphery of the inner frame are adjustable to urge the outer frame outward from the inner frame, to fit against the inside of a window casing.

The outer frame preferably comprises elongate expander cap members which are generally U-shaped in cross-section. These expander cap members are connected to the inner frame with the base of the "U" facing outward, thus providing a base surface to fit against the interior of the window casing. A pair of flanges, the legs of the "U", extend into the window opening, fitting slidingly along respective sides of the inner frame. Corner caps are slidably disposed over the outer frame at each corner, in order to sealingly close the gaps between the ends of the elongate frame elements and the interior surface of the window casing. The window unit of the invention thus presents an attractive appearance, while contributing to conservation of energy used to heat a building and reducing the amount of energy wasted in manufacture and modification of ill-fitting window units and their components.

It is therefore a primary objective of the present invention to provide a window unit which includes an outer frame whose outer dimensions are adjustable to permit use of the window unit in window openings which are not perfectly rectangular.

It is another major objective of the present invention to provide a window unit which may be easily installed and removed.

It is another important objective of the present invention to provide a window unit of which a single size is usable in window openings having a range of sizes.

It is a further objective of the present invention to provide a window unit which efficiently closes the window opening in which it is installed to sealingly trap an insulating layer of dead air between the window unit and a pre-existing single glazed window.

It is a principal feature of the present invention that it includes a plurality of elongate expander cap members which fit slidingly around the jambs and head of a window frame and which are movable outwardly to abut against the interior surfaces of a window casing while sealingly retaining the inner frame in position.

It is a major advantage of the present invention that it permits window units made up in stock sizes to be installed in window openings of standard sizes, despite minor variations in the dimensions or distortion of individual window casings.

It is another advantage of the present invention that it provides a window unit which may be installed in distorted window openings, and yet present a pleasing appearance without the necessity of costly modification of a standard window unit or the manufacture of a specially fitted window unit.

DETAILED DESCRIPTION OF THE DRAWINGS

Figure 1:
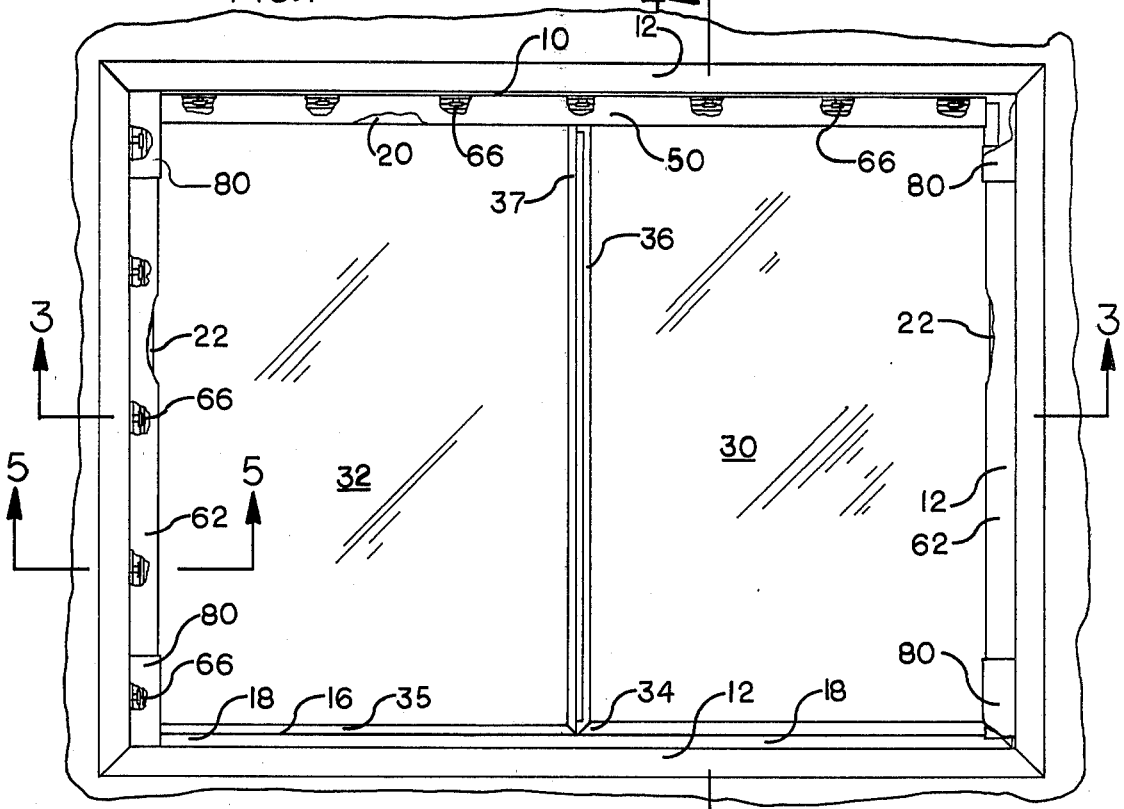
FIG. 1 is a partially cut-away pictorial view of an exemplary window unit embodying the present invention installed as an interior mounted storm window.
Figure 2:
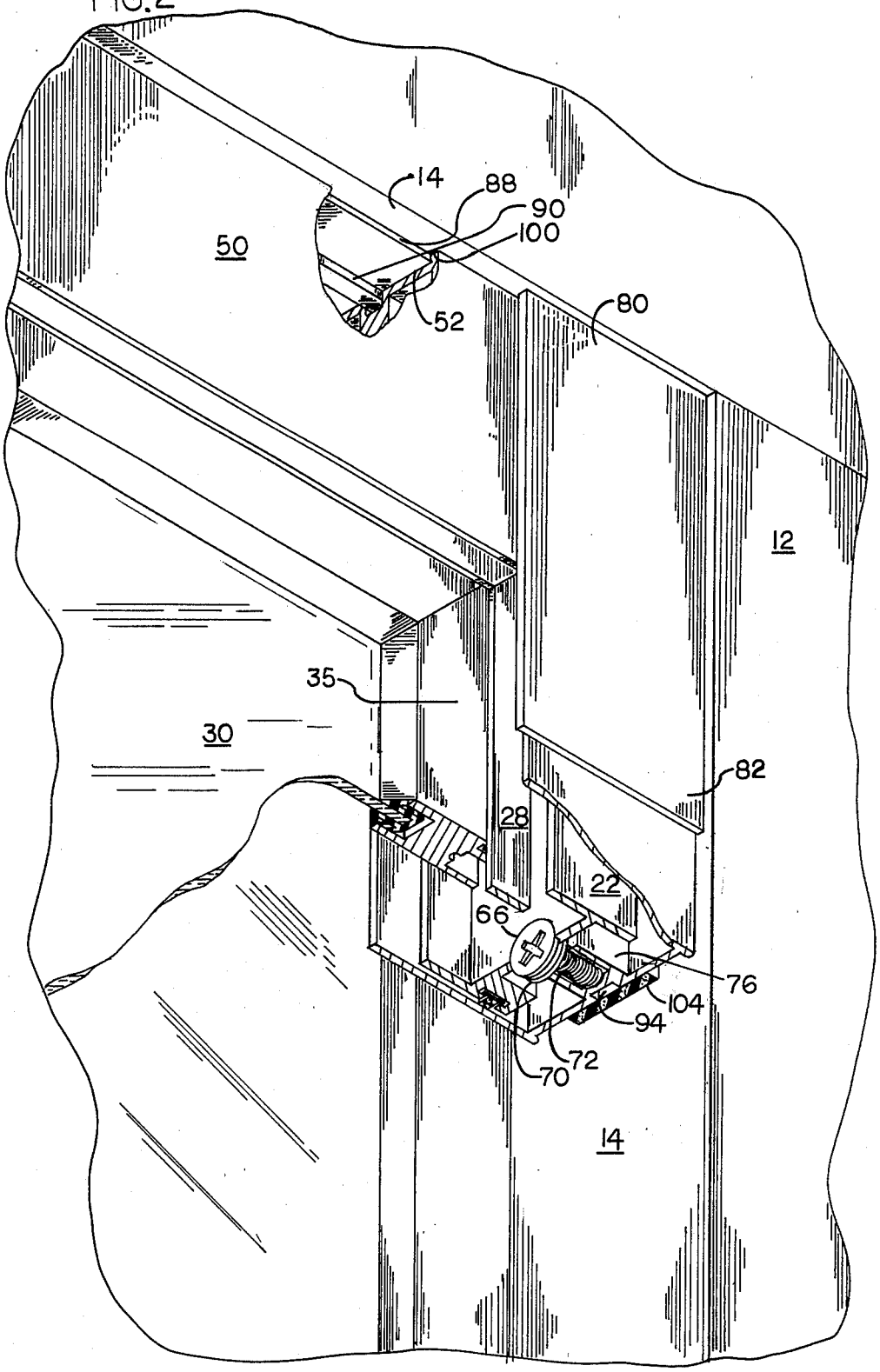
FIG. 2 is a partially cut-away pictorial view of a detail of the window unit shown in FIG. 1, at an enlarged scale.

Referring first to FIGS. 1 and 2 of the drawings, an exemplary window unit 10 embodying the present invention is shown installed as an interior storm window in a window opening surrounded by a casing 12 having inwardly facing surfaces 14.

Figure 3:
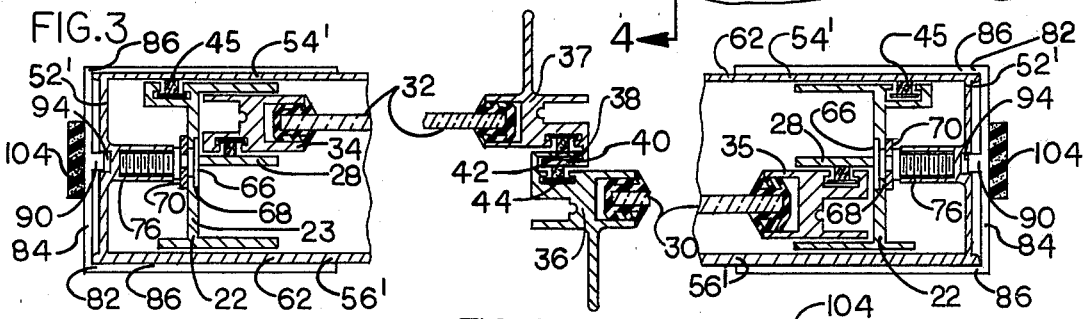
FIG. 3 is a sectional view, at an enlarged scale, of the window unit shown in FIG. 1, taken along line 3—3.
Figure 5:
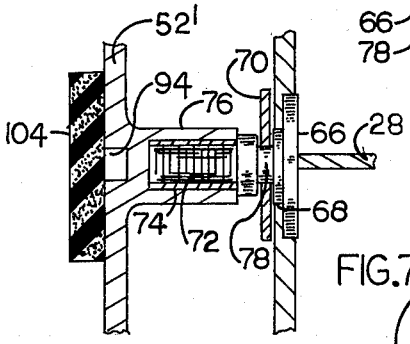
FIG. 5 is a sectional detail view, at an enlarged scale, of the window unit of FIG. 1, taken along line 5—5.
Figure 6:
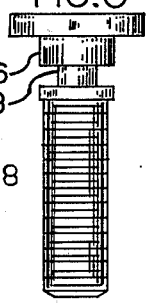
FIG. 6 is a view of an exemplary jackscrew usable in the window unit shown in FIG. 1.
Figure 4:
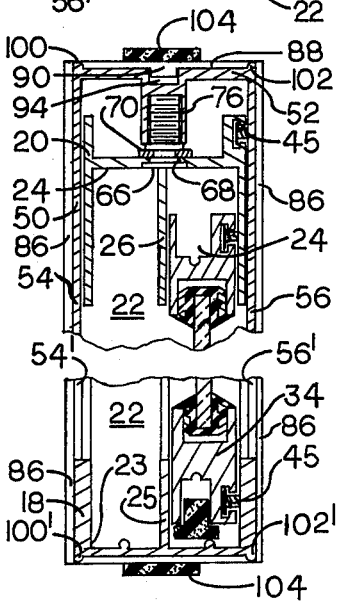
FIG. 4 is a sectional view, at an enlarged scale, of the window unit shown in FIG. 1, with one window panel removed, taken along line 4—4.

The window unit 10 comprises a rectangular inner frame 16 having a horizontally extending elongate inner frame sill 18 and a horizontally extending elongate inner frame head 20 of equal length, the ends of the inner frame sill 18 and head 20 being connected to one another by respective vertically extending inner frame jambs 22. Each of the inner frame members 18, 20, and 22 defines a pair of parallel tracks 23 or 24 separated by respective medial webs 25, 26, and 28, as may be seen better in FIGS. 3 and 4. A pair of glazed panels 30 and 32 have frames 34 and 35 which are slidably disposed in respective ones of the tracks 23 and 24, the panels overlapping one another in the central portion of the window unit. An interlocking strip 38 or 40 is provided on one side of each of the respective panel frame portions 36 and 37 of the panels 30 and 32, and bands 42 and 44 of weather stripping material such as a nylon pile material cooperate with the interlocking strips 38 and 40 to provide a substantially air tight seal between the respective panel frame portions 36 and 37 when the panels 30 and 32 are disposed in respective opposite ends of the window unit. Similar bands 45 of weatherstripping material may be provided along the sides of the panel frames 36 and 37, to seal against the interior of the respective one of the tracks 23 and 24.

The tracks 24 defined in the inner frame head 20 are deeper than the tracks 23 in the sill 18 and jambs 22 and 18, allowing the panels 30 and 32 to be lifted clear of the tracks 23 in the inner frame sill 18, so that the bottom of each panel may be swung free, permitting the panels 30 and 32 to be easily removed from the inner frame 16.

An elongate horizontal expander cap member 50, which may be a channel of generally "U"-shaped cross-section, is slidably disposed about the inner frame head 20, extending along the entire length thereof. The expander cap member 50 includes a base portion 52 defining the top edge of the window unit 10, and a pair of parallel flanges 54 and 56 each disposed generally perpendicular to the base portion 52. The flanges 54 and 56 extend inwardly from the periphery of the window unit 10, along the interior and exterior sides, respectively, of the inner frame head 20, which is received entirely within the channel thus defined by the expander cap member 50.

Similarly, a pair of vertical elongate expander cap members 62 are disposed respectively along the inner frame jambs 22. The top expander cap member 50 extends across the upper ends of the vertical expander cap members 62, while the vertical expander cap members 62 rest upon the inner frame sill 18, which is of thicker material than the jambs 22, to match the expander caps in width and define tracks 23 of width equal to that of the tracks 23 in the inner frame jambs 22.

The expander caps 50 and 62 are connected to the respective inner frame head 20 and jambs 22 by means of a plurality of jackscrews 66 which extend through apertures 68 defined in inner frame head 20 and jambs 22 at spaced apart locations, where portions of the respective medial web 25, 26, or 28, are removed. Each of the jackscrews 66 is retained in its respective aperture 68 by a keeper 70, and extends into a threaded aperture 72, preferably defined in a threaded steel insert 74 installed in a corresponding location in a rail 76. The rail 76 is connected to and extends along the interior of the base portion 52, between the flanges 54, 54', 56, and 56' of the respective expander cap 50 or 62.

Figure 7:
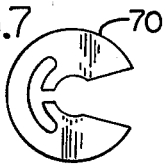
FIG. 7 is a top view of an exemplary keeper usable with the jackscrew shown in FIG. 6.

The keeper 70, shown most clearly in FIG. 7, fits around a reduced diameter portion 78 of the jackscrews 66, thus transferring force from the jackscrew 66 to the respective inner frame member 20 or 22 when the jackscrew 66 is rotated outward from the threaded insert 74. This displaces the respective expander cap 50 or 62 outwardly with respect to the respective inner frame head 20 or jamb 22, adjusting the position of the respective expander cap with respect to the inner frame 16. The window unit 10 can thus be located and securely retained within the window casing 12 by forcing the expander caps 50 and 62 and the inner frame sill 18 against the inwardly facing surfaces 14 of the window casing 12.

At each corner of the window unit 10 is a corner cap 80 which includes a channel portion 82 disposed surroundingly about the respective end of one of the vertical expander cap members 62. The channel portion 82 includes a base 84 and a pair of flanges 86, extending generally perpendicularly therefrom and parallel to one another. A tab 88 also extends generally perpendicularly from the base 84 and may be formed by removing a portion of the flanges 86 from extruded aluminum channel stock and thereafter bending the base 84 to extend perpendicularly between the remaining portions of the flanges 86.

Each cover 66 is installed so that the tab 88 extends along the top side of the top expander cap member 50, or the bottom of the inner frame sill 18, thus retaining the respective corner cap 80 in a position covering any gap between the ends of the inner frame sill 18, the expander caps 50 and 62, and the inwardly facing surfaces 14 of the window casing 12.

A rib 90 extending along the base 84 and tab 88 projects inwardly between the flanges 86 and fits into a respective groove 92 or 94 defined in the outer side of each expander cap 50 or 62. Preferably, the expander cap 50 and inner frame 18 include outwardly projecting edge beads 100 and 102, between which the respective tabs 88 fit, so that the tabs 88 are hidden from view.

It will be understood that provision of suitably deep expander cap members 50 and 62 will permit use of window units 10 according to the invention having a possible variation of up to several inches of height and length. However, for the sake of appearance and economical use of frame material, the range of adjustment will usually be limited to less than two inches.

The window unit 10 of the present invention is preferably installed within a window casing 12 with a strip of a resilient compressible insulation material, such as a closed cell neoprene weather stripping tape 104, surrounding the entire periphery of the window unit 10, adjacent to the window casing surfaces 14. The tape 104 then provides an air seal, while providing some protection for the finish of the surfaces 14.

A preferred sequence for installation of such a window unit 10 is to place the window unit within the window casing 12, in an appropriate position, with the corner covers 80 and the weather stripping tape 104 in place. The respective jackscrews 66 located in the upper ends of the inner frame jambs 22 are then adjusted to move the expander caps 62 outward to contact the respective portions of the inwardly facing surfaces 14. Next, the jackscrews 66 nearest the bottom ends of the inner frame jambs 22 are adjusted to tighten the lower ends of the expander caps 62 against the surfaces 14.

Starting in the center of the inner frame 20, the jackscrews 66 in the top expander cap 50 are adjusted sequentially, proceeding simultaneously in both directions away from the center, until all of them have been adjusted.

Thereafter the four jackscrews 66 which had previously been adjusted on the vertical expander cap members 62 are readjusted. Finally, the remaining jackscrews 66 in the jambs 22 are adjusted, taking care to ensure that the jambs 22 are kept straight.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An adjustable window unit, comprising:

(a) an inner frame having a plurality of inner frame members interconnected to define frame corners, said inner frame members including a horizontally disposed head member and a pair of vertically disposed jamb members;

(b) a respective expander cap member having a pair of opposite ends, said expander cap member comprising an elongate channel of generally U-shaped cross-section including a base portion and a pair of parallel flange portions, disposed along at least one of said inner frame head and jamb members, each expander cap associated with one of said inner frame jamb members defining a central groove on a peripheral side thereof;

(c) frame expansion means associated with said window unit for adjustably moving each said expander cap member outwardly relative to the respective inner frame member, for mounting said window unit within a window casing; and (d) corner cap means, fitted over a respective end of at least one of said expander cap members and extending around a respective corner of said inner frame for closing a gap located between said window casing and said end of said expander cap member, said corner cap means comprising an elongate generally U-shaped channel portion, disposed about one of said expander cap members, tab means, disposed generally perpendicular to the length of said channel portion, for extending along another member of said window unit and holding said corner cap in position, and a rib portion located within said generally U-shaped channel portion and adapted to fit within said central groove.

2. The window unit of claim 1, each said expander cap member including a rail extending along said base portion between and parallel to said flange portions, and said frame expansion means including a jackscrew associated with said inner frame member, a thread associated with said rail, and thrust transmitting keeper means attached to said jackscrew and pressing against said inner frame member for retaining said jackscrew in position associated with said inner frame member and urging said expander cap member outwardly from said inner frame member in response to rotation of said jackscrew in said thread.

3. The window unit of claim 1 wherein said inner frame includes an inner frame sill member of a first predetermined width, and said head and jamb members have a predetermined narrower width, said expander cap members each having a width equal to said first predetermined width.

4. The window unit of claim 1 wherein said inner frame includes a pair of parallel elongate track means for receiving at least one window panel slidably disposed in each of said track means.

* * * * *